US006981533B2

(12) United States Patent
Zorzo

(10) Patent No.: US 6,981,533 B2
(45) Date of Patent: Jan. 3, 2006

(54) APPLIANCE FOR PERFECTING THE SNAP CONNECTION AND DISCONNECTION OF THE TANK FOR FLOOR-WASHING APPLIANCE, CONTAINING LIQUIDS WITH A DISCHARGE PIPE INSERTED IN THE ELEMENT THAT SUPPORTS THE TANK

(75) Inventor: Bruno Zorzo, Villa Del Conte (IT)

(73) Assignee: Filmop S.R.L., Villa Del Conte (IT)

( * ) Notice: Subject to any disclaimer, the term of this patent is extended or adjusted under 35 U.S.C. 154(b) by 32 days.

(21) Appl. No.: 10/748,461

(22) Filed: Dec. 30, 2003

(65) Prior Publication Data

US 2004/0165934 A1 Aug. 26, 2004

(30) Foreign Application Priority Data

Jan. 3, 2003 (IT) ..... PD2003A0001

(51) Int. Cl.
*B65B 1/04* (2006.01)

(52) U.S. Cl. ..... 141/351; 141/18; 251/149.1

(58) Field of Classification Search ..... 141/2, 141/18, 301, 302, 351–364; 251/149, 149.1
See application file for complete search history.

(56) References Cited

U.S. PATENT DOCUMENTS

| | | | | |
|---|---|---|---|---|
| 3,765,462 | A * | 10/1973 | Hocq | 141/301 |
| 5,617,906 | A * | 4/1997 | Braatz et al. | 141/21 |
| 5,715,877 | A * | 2/1998 | Sandor | 141/307 |
| 6,193,113 | B1 * | 2/2001 | Hidding | 222/325 |
| 6,698,466 | B1 * | 3/2004 | Cowan et al. | 141/67 |
| 6,708,740 | B2 * | 3/2004 | Wessberg | 141/301 |

* cited by examiner

*Primary Examiner*—Steven O. Douglas
(74) *Attorney, Agent, or Firm*—Thomas S. Baker, Jr.

(57) ABSTRACT

It is a tank (1) for liquids complete with base valve (23) with rapid opening and closure feature rendered operational by positioning on, or by lifting the tank (1) from the support cup (2) which connects with the discharge element (31), this support (3) being supported by the handle projection of the floor-washing appliance itself.

This type of tank (1) and relative support cup (2) complete with discharge element (31) makes it possible to either replace or exchange the tank for others full of floor washing liquid.

14 Claims, 10 Drawing Sheets

Fig. 10
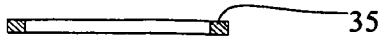
Fig. 11
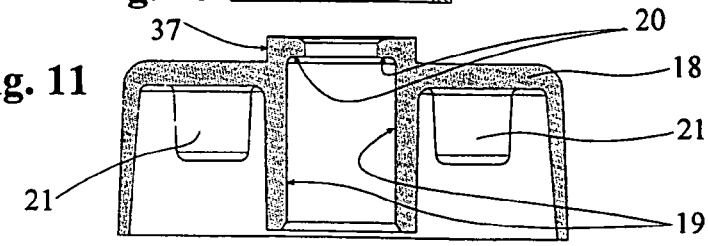
Fig. 12
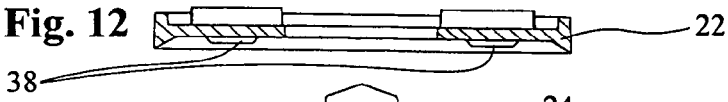
Fig. 13
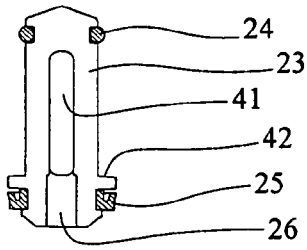
Fig. 14
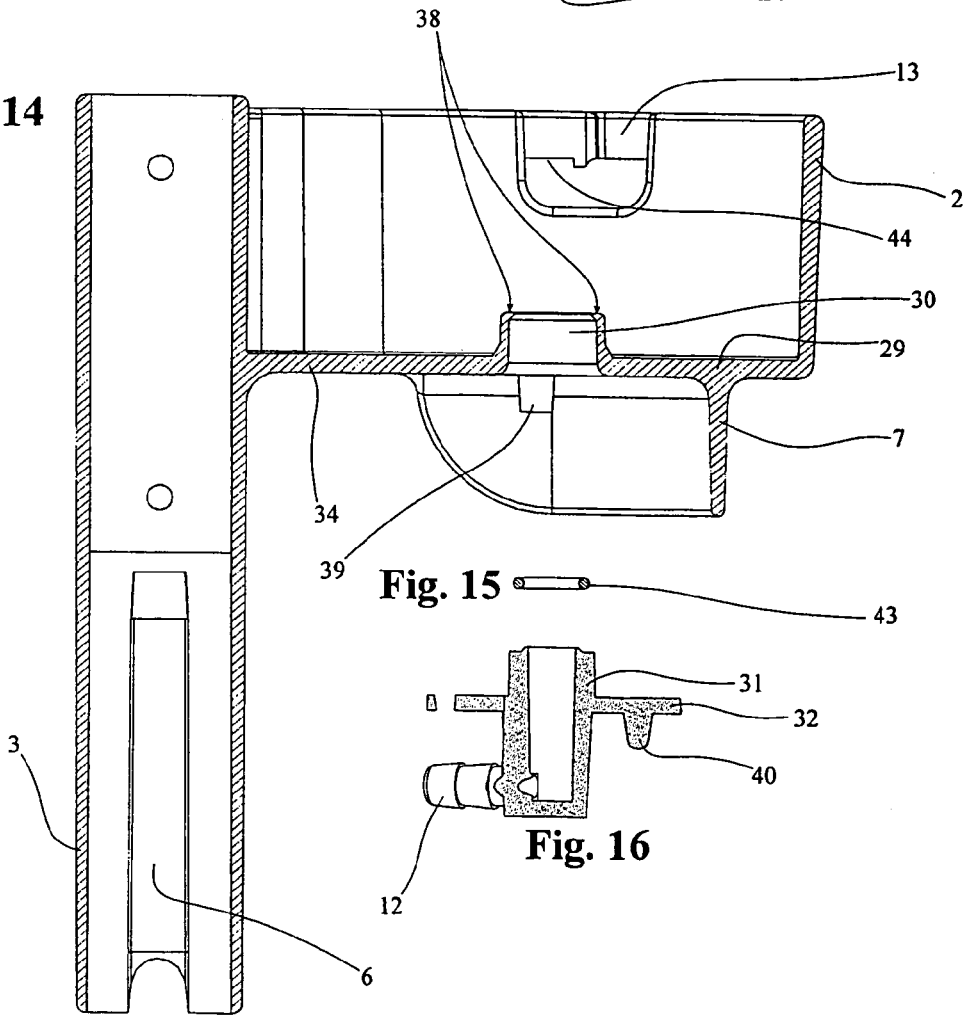
Fig. 15
Fig. 16

APPLIANCE FOR PERFECTING THE SNAP CONNECTION AND DISCONNECTION OF THE TANK FOR FLOOR-WASHING APPLIANCE, CONTAINING LIQUIDS WITH A DISCHARGE PIPE INSERTED IN THE ELEMENT THAT SUPPORTS THE TANK

DESCRIPTIVE TEXT

1. Field of Application

The present invention consists in an appliance perfected for the rapid connection and disconnection of the liquid tank applied to a floor washing appliance with liquid discharge pipe which leads from the tank support, supported by the projecting handle.

The advantages being that the liquid tank may be easily positioned and removed, even if it is full of liquid, without the risk of any liquid leakage from the valve at the bottom of the tank.

2. Technical Details

It is well known that the floor washing appliance field includes a vast range of elements with liquid tank supported by the handle.

There are tanks that are supported sideways in a stable manner by the handle, as well as tanks which are designed so that they are co-axial to the handle. In the case of those tanks which are joined to the handle, they are filled by removing the lid and pouring the liquid inside. In order to change the type of liquid used it is necessary to empty the tank by overturning the entire element.

There are also tanks supported by the handle projection which may be removed and replaced easily every time it is necessary to vary the type of liquid used or when the liquid contained inside runs out.

Amongst those tanks liable to be replaced are those in which it necessary to overturn the inside of the element or others in which the replacement operation is undertaken more simply without having to overturn the element, by simply lifting and repositioning them by engaging or disengaging them the engagement element being either snap or connection type.

As concerns the tanks that need to be replaced and in particular in those in which it is not necessary to overturn the element, there are many different designs, featuring different ways of preparing the appliances for connection inside the tank with discharge piping that ends up on ground level which may or may not be intercepted with an exit regulator.

The support fixed to the handle projection of the device that needs replacement is crossed by a pipe which emerges on the top section with a special configuration and which ends up on the lower section with a tubular connection for the attachment of the flexible discharge hose which descends towards the liquid output regulator.

The base of the liquid tank, has a central part from which a pipe exists with a valve, which has a spring closure element, configured in such a way that the body is accessible from below in the vicinity of the actual closure pipe.

When the tank is outside the valve operates and is kept in closed position thanks to the spring.

When the tan is positioned on the actual support on the handle projection the part which projects onto the top section of the pipe that crossed the support and the lower end of the sealing valve, initially match up.

By pressing the tank against the support and exceeding the force of the spring that acts on the valve, this same shifts from the closure position and the pipe that crossed the support comes into communication with the inside of the tank and the liquid contained inside the same, so that it can flow out.

The adaptations undertaken to put the pipe that crosses the support in communication with the pipes that crosses the bottom of the liquid tank are designed in such a way as to ensure that there is no leakage on positioning the tank on the support or on removing the tank from the support and in order to prevent the risk of dripping during this connection or disconnection stage.

The problems that exist on the existing versions relative to rapid connection and disconnection of the tank with discharge valve positioned on the base and underlying discharge piping relate to dripping.

This occurs every time that the tank is replaced or changed.

The dripping action becomes more pronounced in time as the result of the wear on the matching surfaces.

Another disadvantage of the existing designs and which causes dripping both on the support and the tank is due to the fact that the ring shaped seals, whether they be of toroidal or other shape, gradually dry up, but their replacement is not envisage which means that it is necessary to eliminate the entire tank section.

Another problem is the fact that the tubular end for the attachment of the flexible discharge hose is made of a single moulded section joined to the support which means that if this end breaks it is necessary to replace the entire support element.

A further problem is that both in the positioning and in the lifting of the tank from its support in order to complete the fixture connection, the rotation of the tank around its axis does not give the correct insertion position.

The fact that the operator has to find the correct insertion position means that there is a risk that he applies the wrong strain which may damage the ends or the elements to which the ends connect with.

In this last case it would result in the damage to the entire support or tank, making it unfit for use.

Yet another problem is that at the end of the connection operation between the tank and the support, there is nothing to prevent any accidental disconnection which may occur as the result of shaking or vibrations to which the tank is subjected during the use of the appliance to which the support is applied on which the tank is mounted.

Furthermore, another problem is that the tank includes parts which are glued on and in the parts that are not properly sealed in the assembly zones, there is a risk of bacteria growth or the accumulation of other harmful substances.

3. Aim of the Invention

The aim of the present patent is to prevent the dripping of the liquid during the positioning or removal of the tank from its support.

Another aim is to facilitate the replacement of the sealing elements as soon as they become damaged (both as the result of ageing or due to reaction with the liquids with which they come into contact) by preparing all the individual parts which make up the tank including the base and the sealing valve body using elements which can be easily applied and easily detached.

Another aim was to produce the part fitted with tubular end for connection to the flexible discharge hose with a component that could be easily attached and detached from the projecting support element whenever this end section becomes clogged, or wears out or breaks.

Another purpose is that of visually achieving the correct insertion position of the tank in relation to the sear of the support in which it is inserted, thereby preventing the risk of any forcing by the operator both in the positioning and in lifting.

Another aim is that of creating an effective barrier on connection between the tank and the support in order to ensure that the connection is maintained even in the event of shaking or vibrations to which the tank is subjected during the use of the element to which the support is attached and to which the tank is mounted.

The functional assembly of the patented appliance includes the following parts as listed below:

a cylindrical tubular element which form the liquid tank, usually made of transparent material with the bottom part featuring a large circular hole which is co-axial to the body which continues past the bottom with a sturdy cylindrical element which is also co-axial with the overlying body. The lower surface of the base walls features cylindrical grooving in the vicinity of the opening hole, which constitutes the slot for the seal to which an underlying element will be applied. The upper outer edging of the tubular body of the tank features a glazed surface for lid application.

A cylindrical element in the form of an overturned glass with the same internal dimensions as the covering of the tank, the head wall of which at the centre is continuous with the slot of the cylindrical tubing for the base valve of the tank. The tubular slot for the valve which is co-axial to the wall of the overturned glass, with an axial extension equal to the depth of the overturned glass element. So that once the overturned glass element is inserted into the pipe covering section, it crossed the circular opening of the tank bottom. This overturned glass circular element is fixed to the base of the tank by means of screws, so that its top section, undertakes a compression action, to create the sealing potential of the seal located in the grooved slot on the bottom section of the tan.

A cylindrical valve body axially perforated, with the exception of only the top section, with side windows in communication with the axial slot, to be positioned in the cylindrical overturned glass slot. This valve body has relative seals both at the top and the bottom, the lower seal is positioned against the internal wall,. While the top seal is positioned against the external tip of the edging of the tubular slot forming part of the overturned glass cylindrical element. The top ring-shaped seal is of circular (toroidal) section.

The lower ring shaped seal is configured in a U shape, the internal shank rests against eh internal lining of the seat in which the valve moves so as to create a valid sealing action. Thanks to the smoothness and elasticity of the external shank and the extended supporting surface area, guarantees excellent sealing, without creating any difficulty in the actual movement of the valve itself.

At the lower end, the valve body, above the seat of the lower seal, is fitted with an extension which acts as a batten for the helical spring which surrounds it in the central zone. This mounted spring will be pre-charged against a fixed batten formed by a retracted edging present on the top edge of the cylindrical slot in which the valve moves. The valve is maintained in its slot with the pre-charged spring thanks to the seal applied to top end of the valve and this seal in idle valve position undertakes to withhold it. The valve as described above is mainly concerned with liquid flow. The volume relating to the lateral edging of this valve in communication with the axial slots on the lower parts. The mass of the lateral opening of this valve in communication with the axial slots on the lower part, constitutes, when the liquid has flowed out of the tank, and the detachment of the tank from the support cup, the quantity of residual liquid that has not been discharged, but being retained as the result of a compression action, makes it non-drip.

A cup support connected laterally to a tubular sleeve to be inserted and fixed on the handle. In the central co-axial zone on the bordering wall section raised above the cup, there is a cylindrical ridge element with a through hole, the top end of which has a small retracting edge. A tubular pipe is inserted inside the slot which at the lower end proceeds with a tubular end arranged at right-angles for attachment to the flexible discharge pipe. A ring-shaped seal is inserted between the retracting edge of the slot and the top of the tubular section which ensures the sealing between the two surfaces which press on it. The sleeve to be inserted and fixed to the handle, in the vicinity of its extension, has a cylindrical shaped enlargement in order to allow the flexible pipe to pass through it which comes from the tubular end section positioned at the lower end of the base section of the cup support in order to protect it against the risk of any obstacles that may be encountered on moving the appliance. The lower part of the support cup has a portion of tube covering which surrounds it, for protective purposes, to protect the tubular pipe for attachment to the flexible hose.

A tubular element making up the discharge pipe, made in such a way as to enter the cylindrical slot positioned at the centre of the base of the cup support complete with intermediate flange for fixture on the lower side of the support cup. The pipe, has an indentation at the top, with slightly raised internal surface, to facilitate its insertion into the support slot, in order to hold a toroidal shaped seal, which is already inserted and acts to compress it against the edging present on the top part of the same cylindrical slot. The seal positioned at the top of the cylindrical raised hole in which the pipe is inserted, emerges with a good part of its upper internal surface.

The tubular element which makes up the discharge pipe, continues downwards at an angle with a tubular end for attachment of the flexible piping which descends to ground level.

The above description is further clarified by the enclosed drawings.

FIG. 1 provide an axonometric view of the appliance applied to the handle of a floor washing appliance of type featuring control handle for the regulation of liquid flow which descends down through the flexible pipe connected to the tubular end connected to the tank support.

Figure 1:
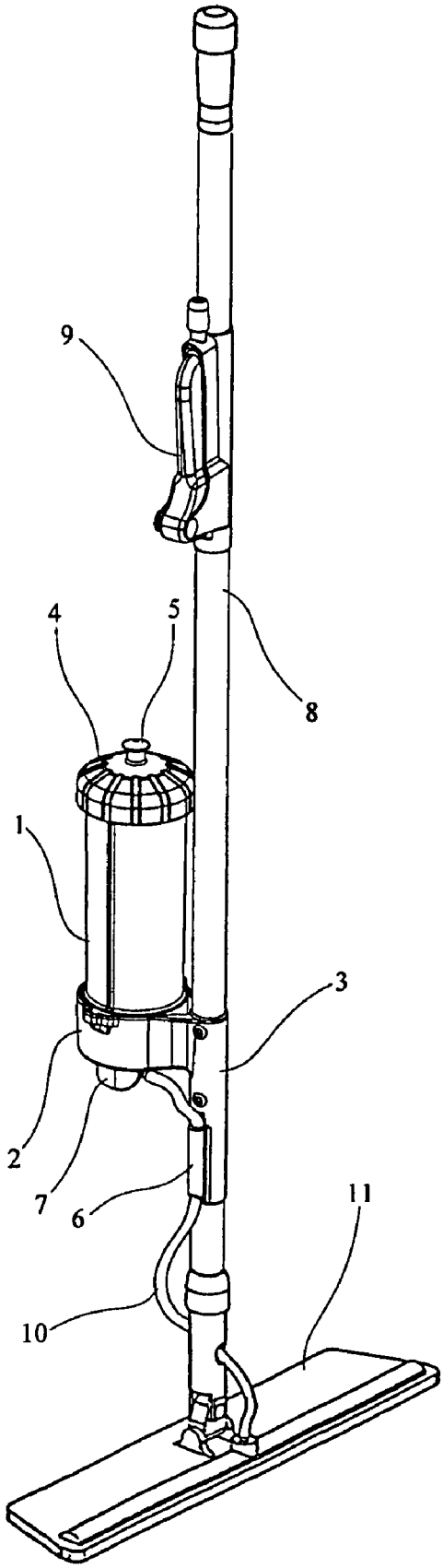
Figure 2:
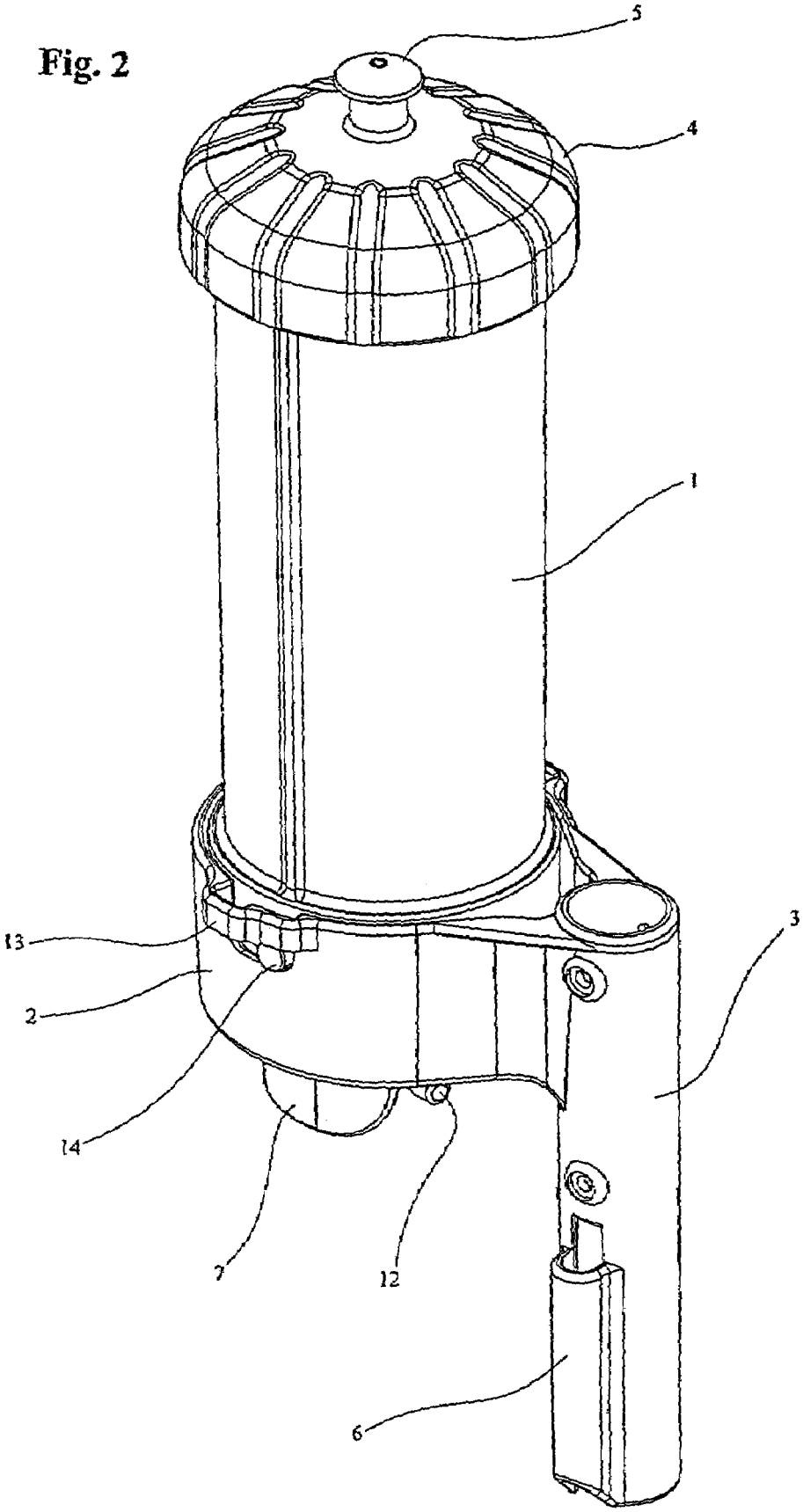
FIG. 2 shows and axonometric view of the appliance complete with tank with lid, mounted coupled on the projecting support with a sleeve to be inserted and fixed onto the handle of the appliance.
Figure 3:
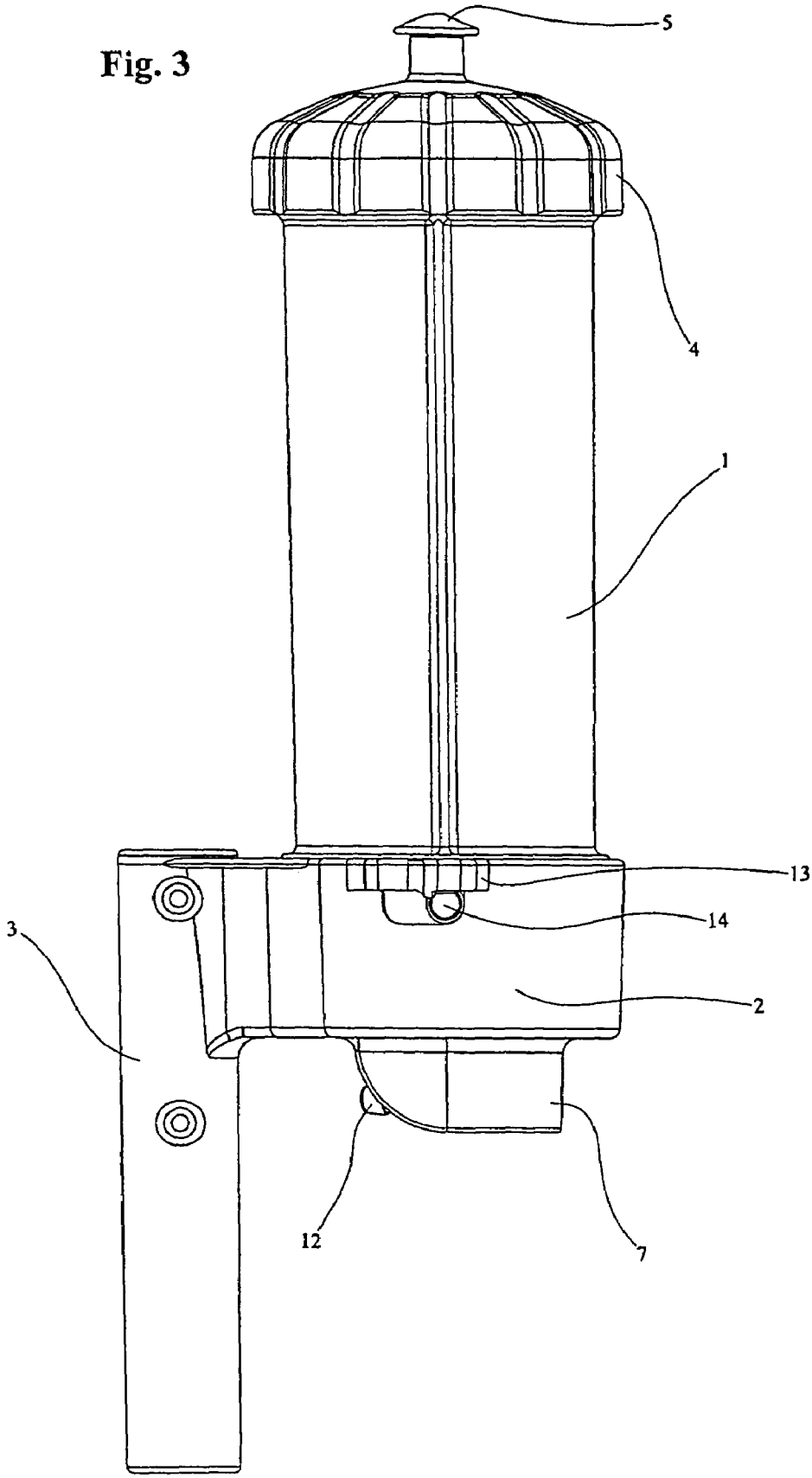
FIG. 3 is the same plane view of the appliance as shown in FIG. 1.
Figure 4:
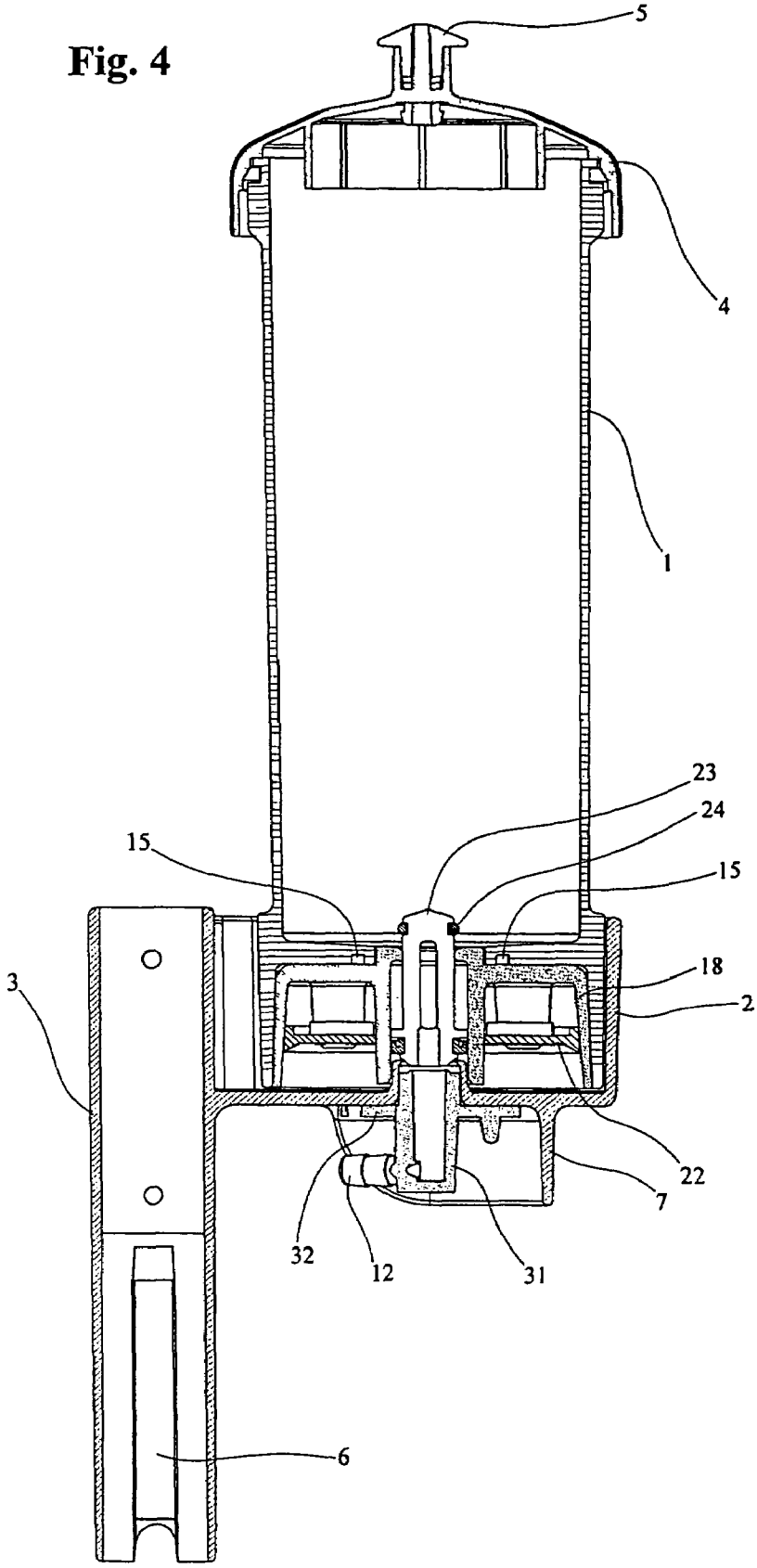
FIG. 4 shows the appliance as illustrated in FIG. 2 sectioned by means of a vertical median plane.
Figure 5:
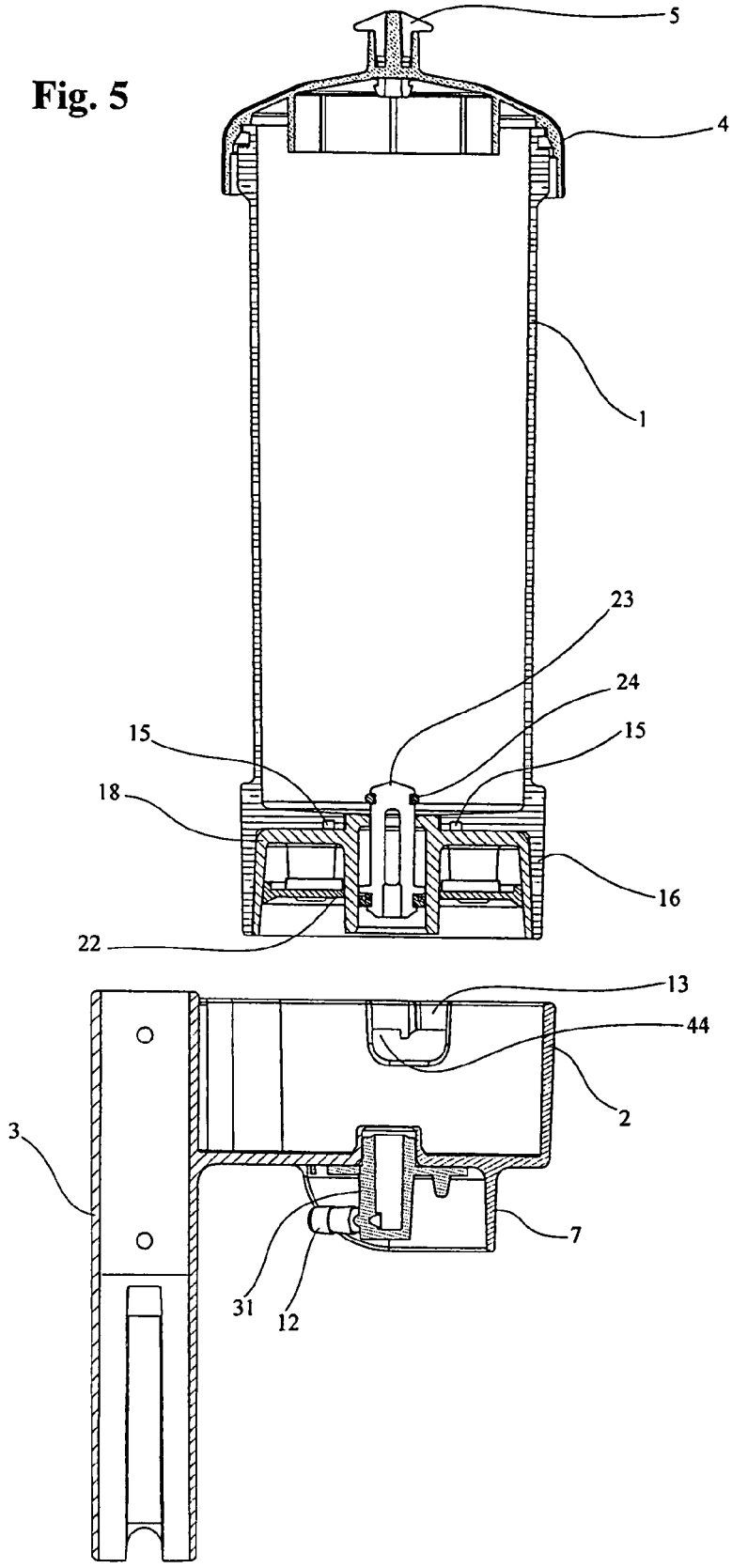
FIG. 5 shows a sectional view of FIG. 3, in which the tank complete with its components is shown out of action outside the support.
Figure 6:
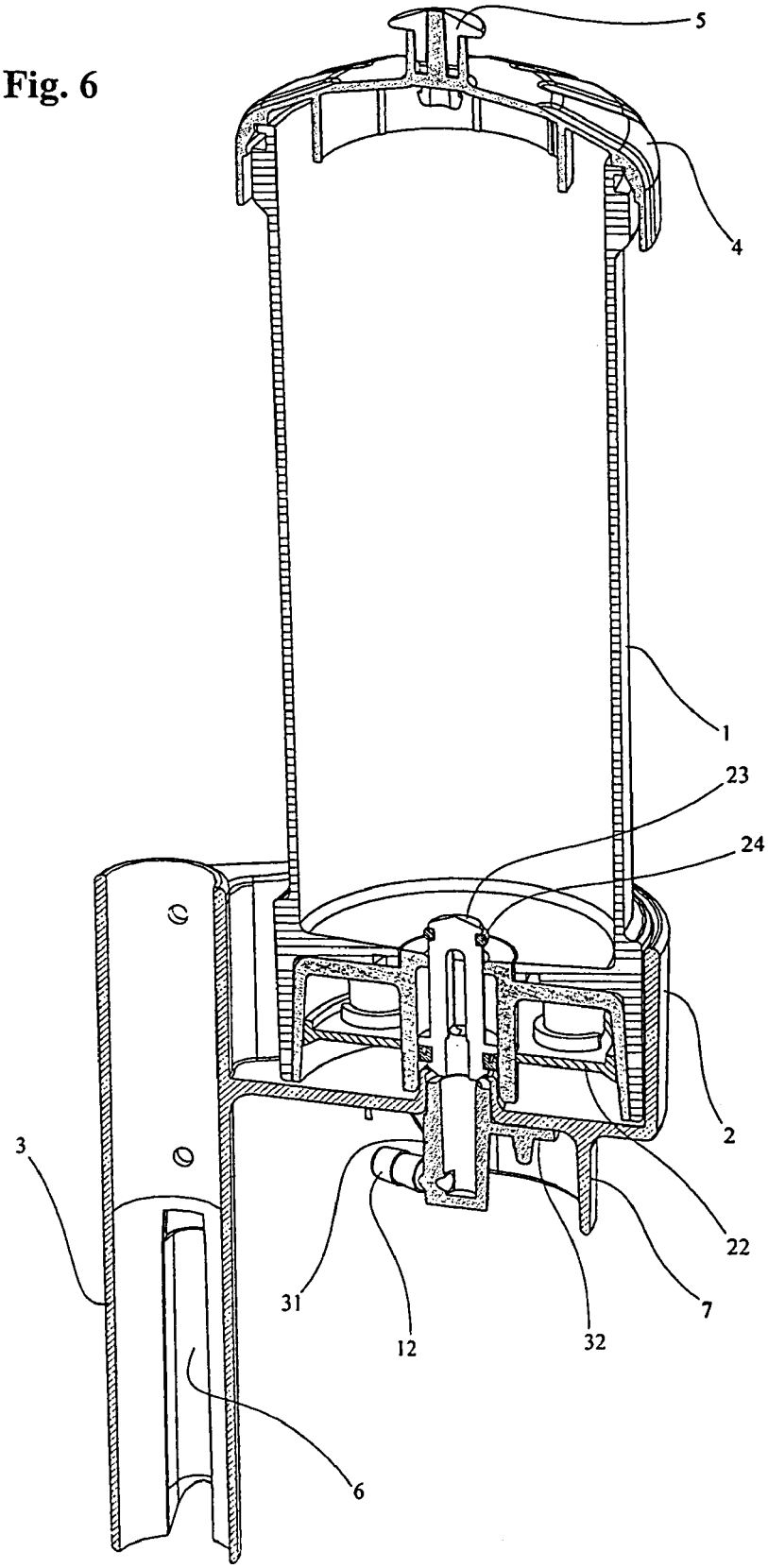
FIG. 6 is a view according to a vertical median plane corresponding to FIG. 1 rotated by 180°.
Figure 7:
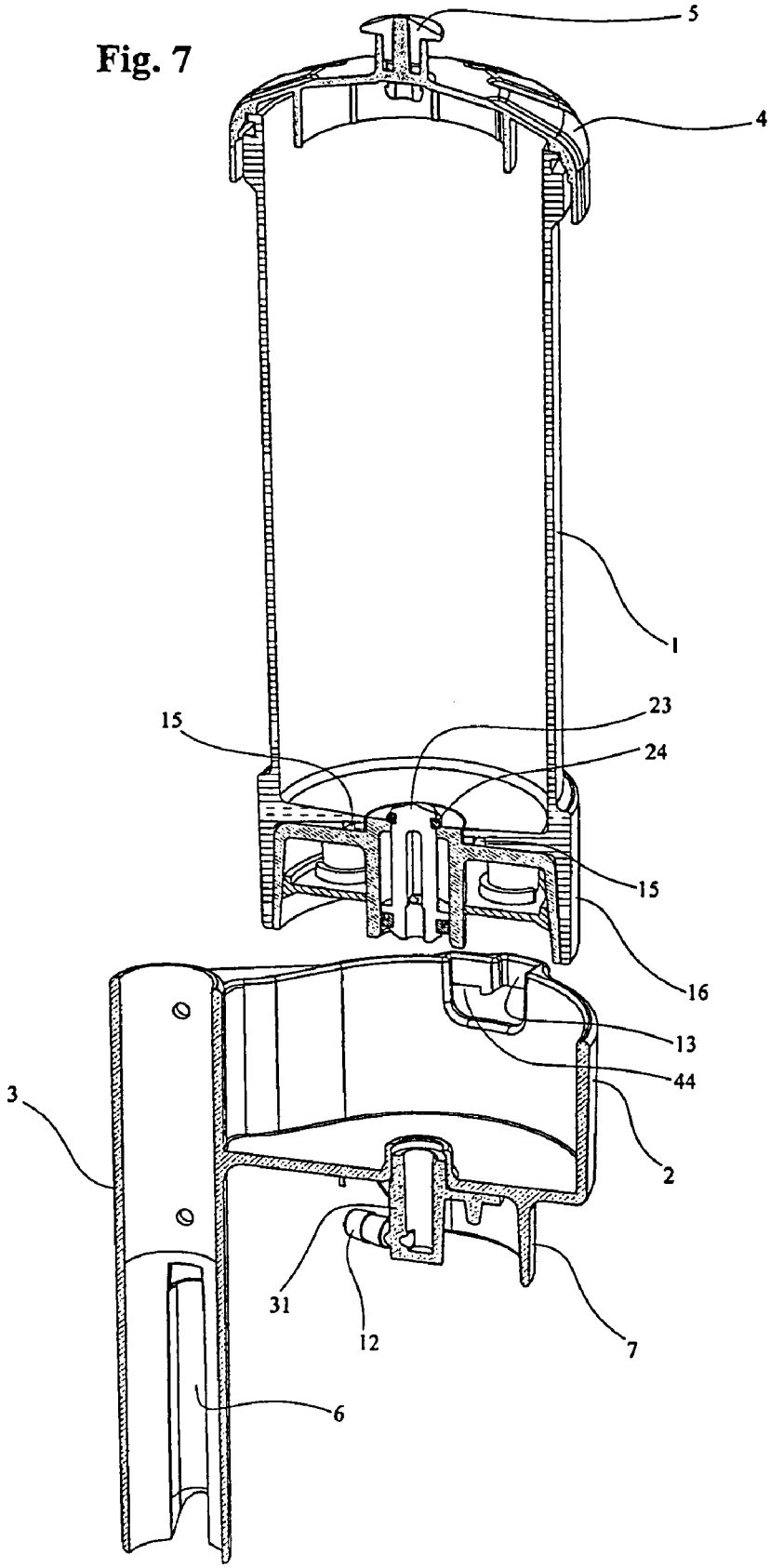
FIG. 7 is a view corresponding to FIG. 6 in which the tank is shown out of action above the tan.
Figure 8:
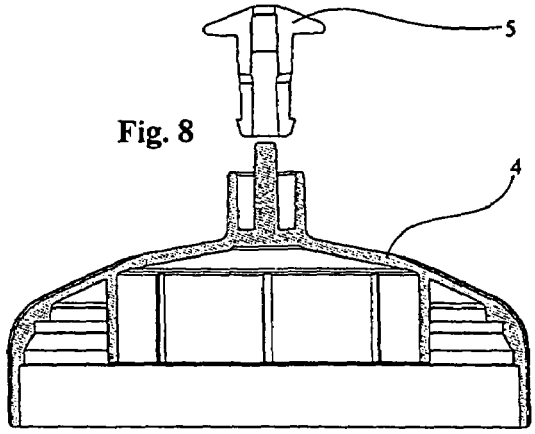
FIG. 8 is a sectional view of the lid out of action and positioned above the ventilation regulation cap.
Figure 9:
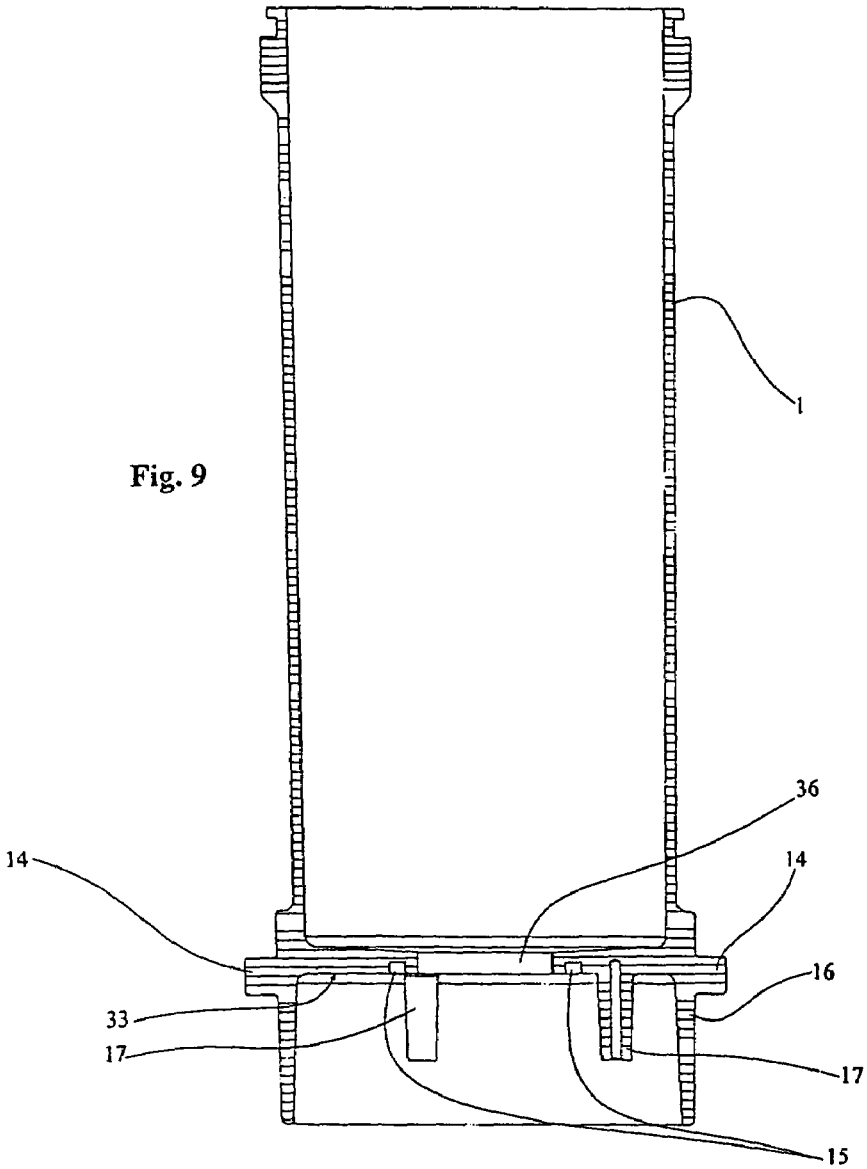

FIG. 9 provides a sectional view of the tank with lower pipe covering element.

FIG. 10 provides a sectional view of the ring-shaped seal to be positioned in the grooved slot on the lower surface of the tank bottom.

FIG. 11 shows a sectional view of the overturned glass element with the cylindrical slot at the centre for the valve to be inserted into the tank covering section.

FIG. 12 shows a sectional view of the circular crown disk which, on insertion into the overturned glass element retains the screw heads (not shown in the drawing) in order to fix and to secure the overturned glass element against the bottom of the tank.

FIG. 13 shows a sectional view of the base valve complete with sealing elements.

FIG. 14 shows a sectional view of the cup support, supported by the projecting sleeve to be inserted and fixed to the handle of the tool, complete with through hole at the centre, with upper retracting edging, the hole constituting the cylindrical slot for the insertion of the upper part of the tubular discharge element.

FIG. 15 shows a sectional view of the seal which, inside the slot of the top part of the discharge pipe needs to be pressed against the retracting edge of this slot and the top of this same discharge pipe.

FIG. 16 shows a sectional view of the tubular element relative to the discharge pipe complete with intermediate flange for screw fixture (not shown in the diagram) on the lower level of the support cup.

The upper part of this discharge pipe is realized in such a way as to enter the cylindrical slot with hole positioned centrally on the bottom of the support cup for the compression of the ring seal (shown in FIG. 15), against the edge present on the top of this same cylindrical slot.

Figure 17:
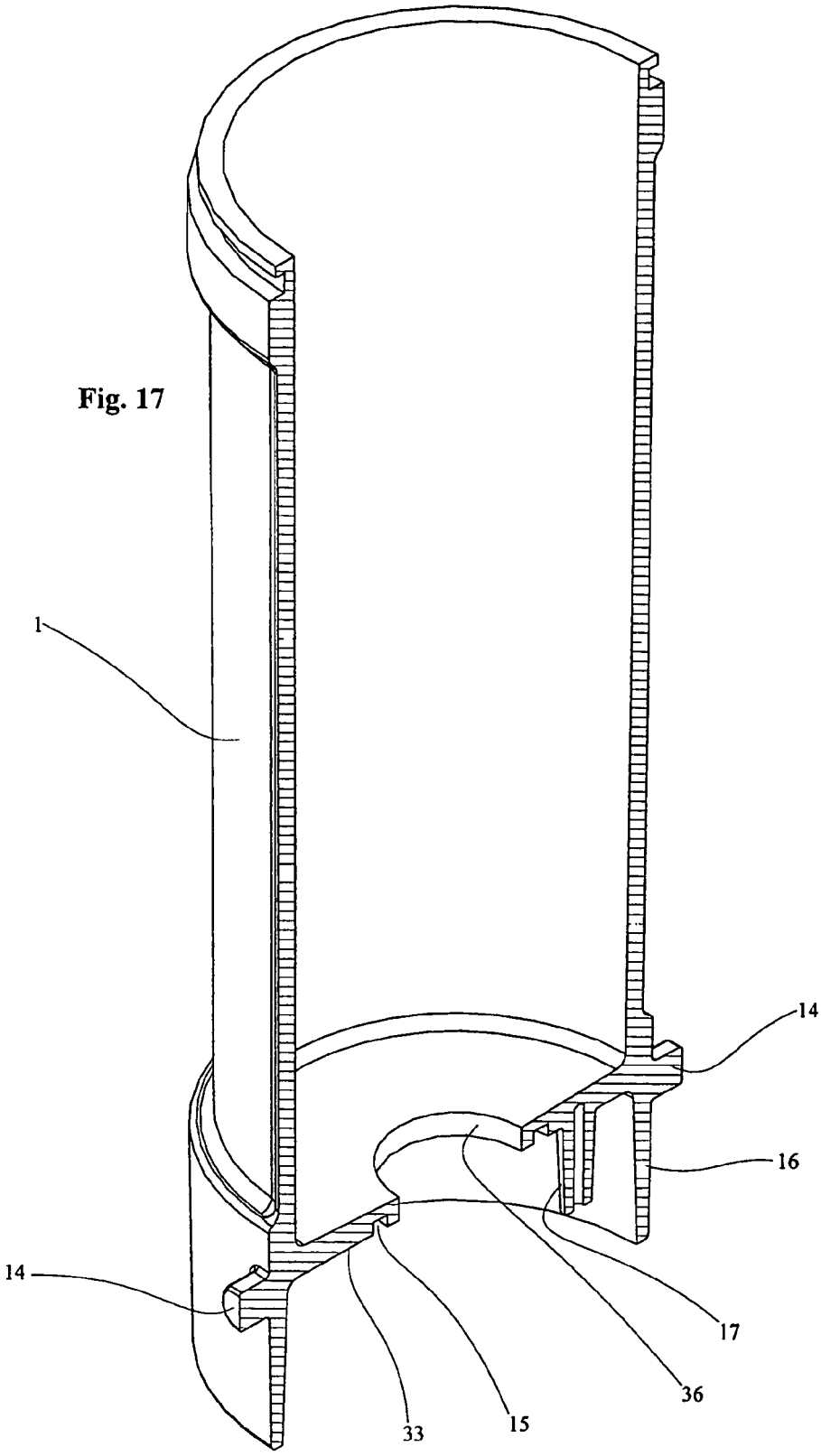

FIG. 17 shows an axonometric sectional view of the tank with covering element, corresponding to FIG. 9.

The assembly of the various parts of the tank with valve, and the cup support with sleeve and discharge pipe, the positioning and tile removal of the tank in the support cup, the fixture and disconnection of the same is undertaken as described below.

Insert seal 35 into slot 15 on the lower surface of the bottom 33 of tank 1.

Take valve 23 and apply the ring seal 25 with U-shaped section. Insert the helical spring from above which rests against the circular batten 42.

Insert valve 23 equipped with seal 25 and the helical spring (not shown in the drawings) into slot 19 of the overturned glass element 18 and push it compressing the helical spring against the retracting edge 20 of slot 19 until the top of valve 23 projects over the emerging part 37 of the overturned glass element 18.

Apply seal 24 into the relative slot made in the vicinity of the top part of valve 23.

Suspend pressure exerted on the lower part of valve 23 after its insertion into slot 19.

The pre-charge force of the spring makes the valve descend until seal 24 resting against the top part of the emerging part 37 secures the anti-extraction valve whilst at the same time effecting the sealing closure of slot 19.

Then insert the overturned glass element inside the pipe covering 16 complete with valve 23, completely assembled so that the emerging part 37 is positioned inside slot 36 of the tank 1 and so that its tubular ends 21 connect with the pegs 17 of the tank.

Insert the circular crown disc 22 inside the cavity of the overturned glass element 18 and insert the screws (not shown in the diagrams) into slots 38.

These self-threading screws are screwed into the blunt holes arranged axially in the pegs 17 of tank 1

The tightness of the screws affects the compression of the seal 35 between the bottom section of glass element 1 and the top section of the overturned glass element 18.

To complete the tank assembly screw on lid 4 with ventilation lid 5.

Then take the cup support 2 with projecting sleeve support 3. Insert inside slot 30 seal 43 until it comes to stop against the edge section 38. Then insert the top part 31 of the discharge pipe until flange 32 comes against pegs 39 present on the bottom 20 of cup 2.

Then proceed to apply the screws (not shown in the drawings) into the holes 40 of flange 32 and screw into the relative pegs 39.

Seal 43 is compressed between edging 38 and the top of the discharge pipe 31.

This seal 43 compressed in this way emerges with a good part of its toroidal section on edging 38.

Insert sleeve 3 into the handle of tool 8 and secure it. Apply the flexible pipe 10 into the end section 12 of sleeve 31 and then make it pass through the expansion 6 of sleeve 3 until it reaches strip 11, ensuring that it is intercepted by an eventual liquid exit regulation appliance.

Then take tank 1 and position it on support cup 2, positioning pegs 14 fitted to the exterior of the pipe covering element 16 and insert into the slots of the bayonet element 13 present on the top edge of cup 2. By applying pressure downwards on tank 1 the lower part of slot 19 of the overturned glass element 18 reaches and engages the cylindrical raised element 30, 38 which emerges at the centre of cup 2 and the lower part of valve 23 with conical configuration matches up with seal 43 exerting a compression pressure which offsets the pre-charging force of the helical spring.

Seal 24 of the valve therefore will appear raised as compared to the bottom of tank 1 shifting from the emerging top part 37 of the overturned glass 18. The lateral edging 41 of the valve that communicated with axial slot 26 places the interior of tank 1 in communication with the discharge pipe 31 so that the internal liquid can reach the flexible pipe 10 for descent towards ground level.

At the end of the downwards thrust of tank 2 into cup 2 with maximum offset exerted as the result of the force of the helical spring that surrounds valve 23, which makes the tank undertake a rotary action so that its pegs 14 compete the run adhering to the bottom of the bayonet slot 13. The downwards pressure of the tank is suspended and the additional pre-charging force comes into play supplied to the spring by the valve, which causes the tank to rise with the consequent rise of its pegs 14. These pegs 14 on rising enter two slots 44 on the top part of the bayonet slot 13. There is therefore no risk of disconnection of the tank from its support with pegs 14 due to any shaking or blows to the supporting tool. In order to remove and lift the tank from the support it is necessary to undertake the operation in inverse order as previously described for assembly and fixture.

It is therefore necessary to apply adequate pressure to the tank by making the pegs 14 descend from the slots on the bayonet slot 13 and proceed with the tank compressed in this way, making it rotate so that the pegs 13 match up with the vertical grooves on the bayonet slot. With the ending of the compression on the tank 1 , the pre-charging force of the spring of the valve comes into play which acts to close valve 23 and lift tank 1.

From the above, it is clear that any improvements made by specialists in the field, will not affect the patent rights.

What is claimed is:

1. A tank assembly for removable attachment to the handle of a floor-washing apparatus which comprises: a tank having an upper portion and a lower portion; a removable lid affixed to said upper portion; a fluid discharge opening formed in the lower portion; a spring-biased valve mounted in the lower portion of said tank at said fluid discharge opening and movable alternatively between a first valve position in which said fluid discharge opening is open to the allow the passage of fluid there through and a second valve position in which said fluid discharge opening is closed to prevent the passage of fluid there through; a tank receptacle adapted to receive said tank lower portion having a top portion and a bottom portion; a fluid discharge sleeve mounted in the bottom portion of said tank receptacle and connected to a fluid discharge line; tank attachment means for attaching said tank lower portion to said tank receptacle bottom portion; and wherein said receptacle mounted fluid discharge sleeve engages said spring-biased valve affixed to said tank lower portion to move said spring-biased valve to said first valve position to provide fluid communication between said tank and said fluid discharge sleeve when said tank lower portion is attached to said tank receptacle bottom portion.

2. The tank assembly of claim 1 further comprising: a valve housing having a central bore (19) formed therein and affixed to the bottom portion of said tank; wherein said spring-biased valve (23) is mounted in said valve housing central bore (19); a seal seat in said valve housing formed at one end of said central bore; and a first seal (24) mounted on said spring-biased valve which engages said seal seat (32) when said spring-biased valve is in said second valve position.

3. The tank assembly of claim 1, wherein said tank attachment means comprises a peg on one of said tank receptacle and said tank lower portion and a slot in the other of said tank receptacle and said tank lower portion; and wherein said spring-biased valve biases said tank upwardly to thereby clamp said peg in said slot when said tank lower portion is attached to said tank receptacle bottom portion.

4. The tank assembly of claim 1, comprising an outer surface formed on said tank lower portion, an inner surface formed in said tank receptacle and wherein said peg is mounted on said tank lower portion outer surface and said slot is formed in said tank receptacle inner surface.

5. The tank assembly of claim 1 further comprising a seal seat mounted on said spring-biased valve, a sleeve seal mounted in said fluid discharge sleeve and therein said seal seat engages said fluid discharge sleeve seal when said tank lower portion is attached to said receptacle.

6. The tank assembly of claim 5, wherein said sleeve seal is interposed between said fluid discharge line and said fluid discharge sleeve.

7. The tank assembly of claim 5, said spring-biased valve having a spring which biases said spring-biased valve towards said second valve position and simultaneously biases said spring-biased valve seal seat into engagement with said fluid discharge sleeve seal.

8. The tank assembly of claim 2, wherein said first seal acts to retain said spring-biased valve within said valve housing central bore.

9. The tank assembly of claim 2 further comprising a second ring-shaped seal (25) mounted in a slot on the lower part of said spring-biased valve (23) which forms a seal with said housing bore (19) and wherein said second seal is configured in a U-shape so that the internal side adheres to the valve, while the external side which would otherwise tend to expand outwards, thanks to its smoothness and elasticity in fact succeeds in strongly adhering to the internal surfaces (19) of the housing central bore in which the valve is inserted (23) thereby achieving highly effective sealing potential even when it rubs against this surface (19) as the result of valve movement (23).

10. The tank assembly of claim 1, wherein said fluid discharge line has an external tubular end (12) for the rapid attachment of a flexible pipe (10).

11. The tank assembly of claim 1, further comprising a portion of a pipe covering (7) which descends from the lower surface of said tank receptacle (2) to protect one end section (12) of the fluid discharge line (12, 31) against any obstacles which it might encounter during the actual movement of the floor washing device during its use.

12. The tank assembly of claim 10, further comprising a handle mounting sleeve (3) attached to said tank receptacle, said mounting sleeve having an enlargement (6) which protects the portion of the flexible pipe (10) which comes from the discharging tubular end section (12) of the fluid discharge line in order to protect it against the risk of any obstacles that it might encounter during the actual tool movement.

13. The tank assembly of claim 3, the special feature of which is that the pegs and slot which connect the tank and the tank receptacle are arranged according to the "bayonet" connection principle, are visibly accessible to the operator which means that the connection and disconnection operations are facilitated without having to try and attempt to search for the correct position and without any futile forcing of the parts to be connected.

14. The tank assembly of claim 3, wherein the connection between the tank (1) and tank receptacle (2) occurs in accordance with the "bayonet attachment" principle, by inserting the pegs which are fitted externally of the tank on the entrances of the bayonet slots (13) present on the tank receptacle, thereby exerting a downward pressure on the tank in order to offset the spring-biased valve pre-charge pressure, and by rotating the tank so that the pegs (14) are positioned under the slot edging (13) on which there is a special raised cavity (44) to permit the pegs to rise inside, so as to ensure connection stability.

* * * * *